US007182627B1

(12) United States Patent
Huang

(10) Patent No.: US 7,182,627 B1
(45) Date of Patent: Feb. 27, 2007

(54) HIGH ILLUMOSITY LIGHTING ASSEMBLY

(75) Inventor: Bin-Juine Huang, Taipei (TW)

(73) Assignee: Advanced Thermal Devices, Inc., Taipei (TW)

( * ) Notice: Subject to any disclaimer, the term of this patent is extended or adjusted under 35 U.S.C. 154(b) by 0 days.

(21) Appl. No.: 11/326,311

(22) Filed: Jan. 6, 2006

(51) Int. Cl.
*H01R 13/00* (2006.01)

(52) U.S. Cl. ..... 439/487; 362/800

(58) Field of Classification Search ..... 439/56, 439/487, 490; 361/600, 704; 362/227, 294, 362/373, 800
See application file for complete search history.

(56) References Cited

U.S. PATENT DOCUMENTS 5,000,692 A * 3/1991 Taniguchi et al. ..... 439/160
6,428,189 B1 * 8/2002 Hochstein ..... 362/373
6,490,161 B1 * 12/2002 Johnson ..... 361/704
7,070,311 B2 * 7/2006 Lee ..... 362/545
7,121,680 B2 * 10/2006 Galli ..... 362/202
7,126,273 B2 * 10/2006 Sorg ..... 313/512

* cited by examiner

*Primary Examiner*—Khiem Nguyen
(74) *Attorney, Agent, or Firm*—Rosenberg, Klein & Lee

(57) ABSTRACT

A lighting assembly includes a circuit board having light emitting diodes, a heat conductive plate, a soldering plate removably connected to the circuit board and having multiple LED holes to correspond to the LEDs on the circuit board and a fixing plate securely connected to the circuit board after the soldering plate is removed from engagement with the circuit board. A cover has multiple positioning holes to allow extension of threaded bolts through the positioning holes, the fixing holes, the circuit board and into the heat conductive plate to secure engagement among the heat conductive plate, the circuit board, the fixing plate, the transparent plate and the cover.

8 Claims, 8 Drawing Sheets

HIGH ILLUMOSITY LIGHTING ASSEMBLY

BACKGROUND OF THE INVENTION

1. Field of the Invention

The present invention relates to a high illuminosity lighting assembly, and more particularly to a lighting assembly having a soldering plate removably provided thereto so as to provide secured engagement of the light emitting diodes (LEDs) on the base, a fixing plate securely connected to the base, a transparent plate mounted on top of the fixing plate, and a cover securely connected to the fixing plate so as to sandwich therebetween the transparent plate to accomplish the goals of securing the LEDs on the base, and waterproof with the introduction of a sealing material on the base as well as on the fixing plate.

2. Description of Related Art

Light emitting diodes (LEDs) have been widely used in various fields. For example, conventional light bulbs in the traffic lights, warning lights or signaling lights are now changed to LEDs for better illuminosity and better lighting efficiency. In order to best use the LEDs, a heat dissipation structure has to be provided or the lighting assembly using the LEDs as the light source will soon fail due to high temperature concentration.

Normally a conventional lighting assembly is provided with a circuit board and multiple LEDs securely mounted on top of the circuit board. In order to increase heat dissipation efficiency, a heat conducting base (60), as shown in FIG. 10, is provided to an LED (70) mounted on a circuit board (63) having two electrodes (61,62) extending outward therefrom. The LED (70) is first firmly positioned on top of the circuit board (63) and then the LED (70) is soldered to both of the electrodes (61,62). However, during the processing of positioning the LED (70) on top of the circuit board (63), because there is no auxiliary tool or agent to help affix the LED (70) to the circuit board (63) and an adhesive gel has to be used, but after a long period engagement between the LED (70) and the circuit board (63) will become loose due to expansion/contraction from heat variation. Furthermore, if the LED (70) is used outdoors, waterproofing is another factor to be considered.

Illuminosity plays an important role in the design of light assembly. The conventional lighting assembly is shown in FIG. 11 and has a reflection cover (71) mounted in front of the LED (70) to reflect the LED light and an optical lens (72) mounted inside the reflection cover (71) to focus the light from the LED (70). But as there is no careful calculation involved in the mounting of the reflection cover (71) and of the optical lens (72), illuminosity is lost during reflection by the reflection cover (71) and penetration through the optical lens (72). Thus how to prevent illuminosity loss is a key concern of lighting assembly designers.

To overcome the shortcomings, the present invention tends to provide an improved lighting assembly to mitigate the aforementioned problems.

SUMMARY OF THE INVENTION

The primary objective of the present invention is to provide an improved lighting assembly having a soldering plate removably provided thereto so as to provide secured engagement of the light emitting diodes (LEDs) on the base, a fixing plate securely connected to the base, a transparent plate mounted on top of the fixing plate and a cover securely connected to the fixing plate so as to sandwich therebetween the transparent plate to accomplish the goal of securing the LEDs on the base, and waterproofing with the introduction of a sealing material on the base as well as on the fixing plate.

Other objects, advantages and novel features of the invention will become more apparent from the following detailed description when taken in conjunction with the accompanying drawings.

DETAILED DESCRIPTION OF THE PREFERRED EMBODIMENT

Figure 1:
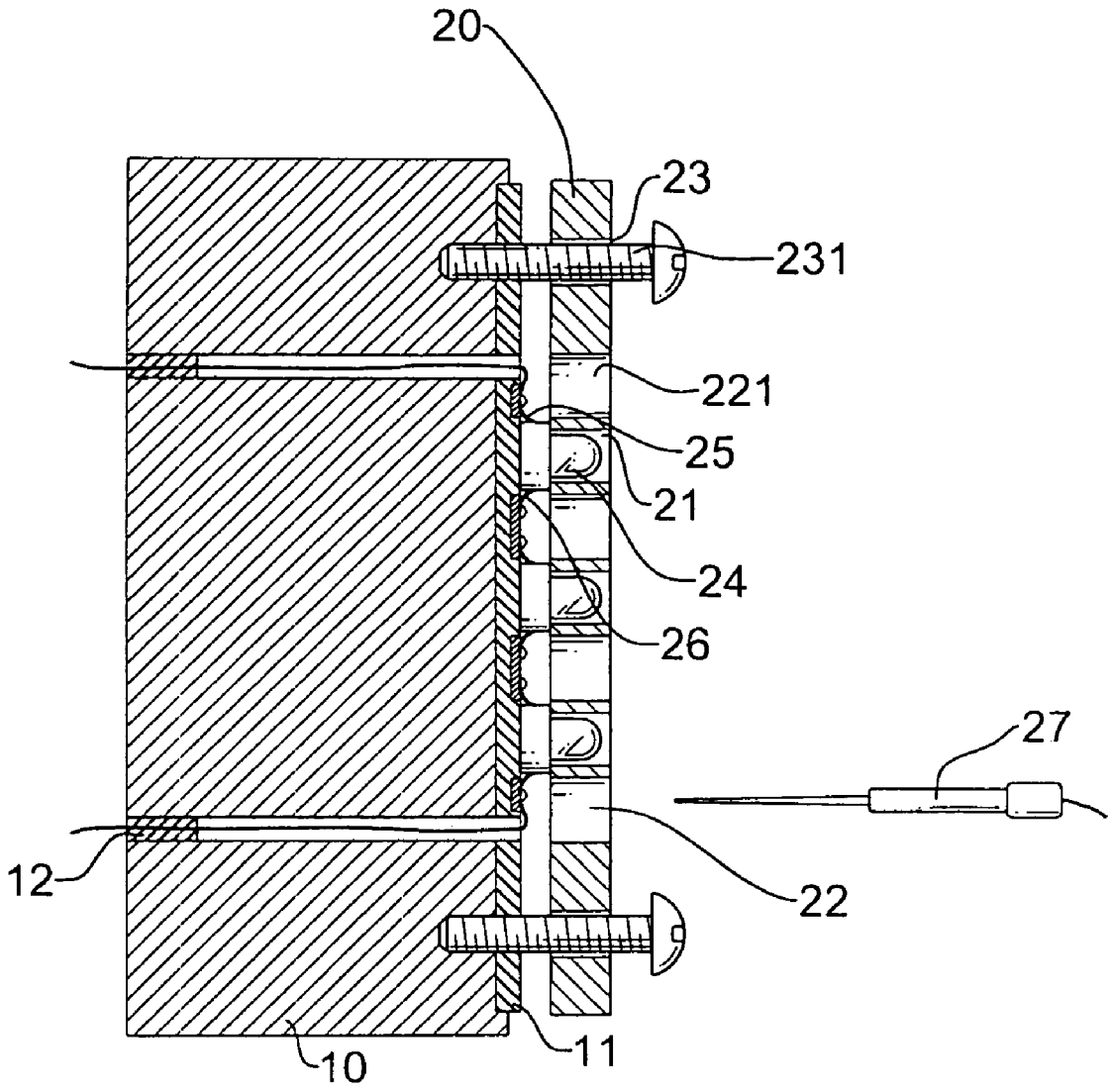
FIG. 1 is a schematic cross sectional view showing the process of soldering the LEDs on the circuit board with the help of a soldering plate removably connected to the circuit board and the base.
Figure 2:
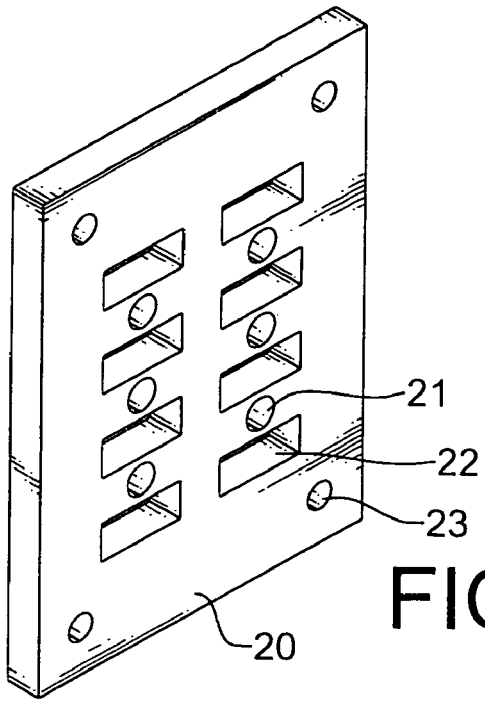
FIG. 2 is a perspective view of the soldering plate.

With reference to FIGS. 1 and 2, it is noted that the lighting assembly in accordance with the present invention includes a heat conductive base (10) having a circuit board (11) securely attached to a side of the heat conductive base (10) and multiple light emitting diodes (LEDs) (24) connected to the circuit board (11) and a soldering plate (20) removably connected to the heat conductive base (10).

The soldering plate (20) is provided with multiple LED holes (21), multiple soldering holes (22) so arranged that a corresponding LED hole (21) sandwiched between two adjacent soldering holes (22) is aligned with a soldering nozzle (27), and screw holes (23) defined in corners of the soldering plate (20) to correspond to screws.

It is noted that when the soldering plate (20) is connected to the circuit board (11) and the heat conductive plate (10), screws (231) are extended through the screw holes (23) of the soldering plate (20), the circuit board (11) and the heat conductive plate (10) to securely engage the soldering plate (20) with the heat conductive plate (10). Thereafter, the soldering nozzle (27) is able to weld electrical wires (25,26) of an LED (24) to the circuit board (11) via the soldering holes (22). That is, each soldering hole (22) corresponds to one of the electrical wires of a corresponding LED (24). After the electrical wires (25,26) of the LEDs (24) are all securely welded to the circuit board (11), the soldering plate (20) is removed from the circuit board (11) by removing the screws (231).

Figure 3:
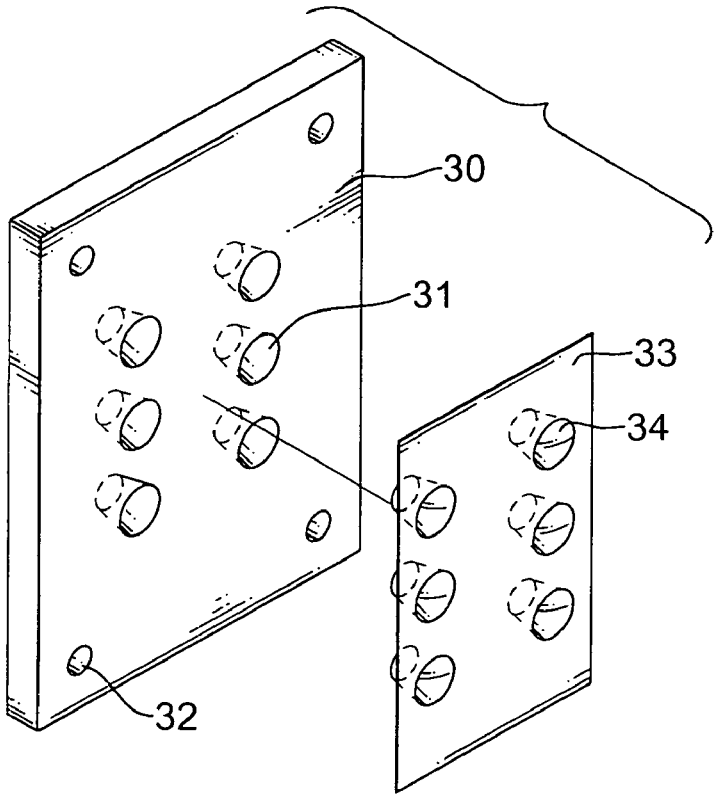
FIG. 3 is a perspective view of a fixing plate and a transparent plate.
Figure 4A:
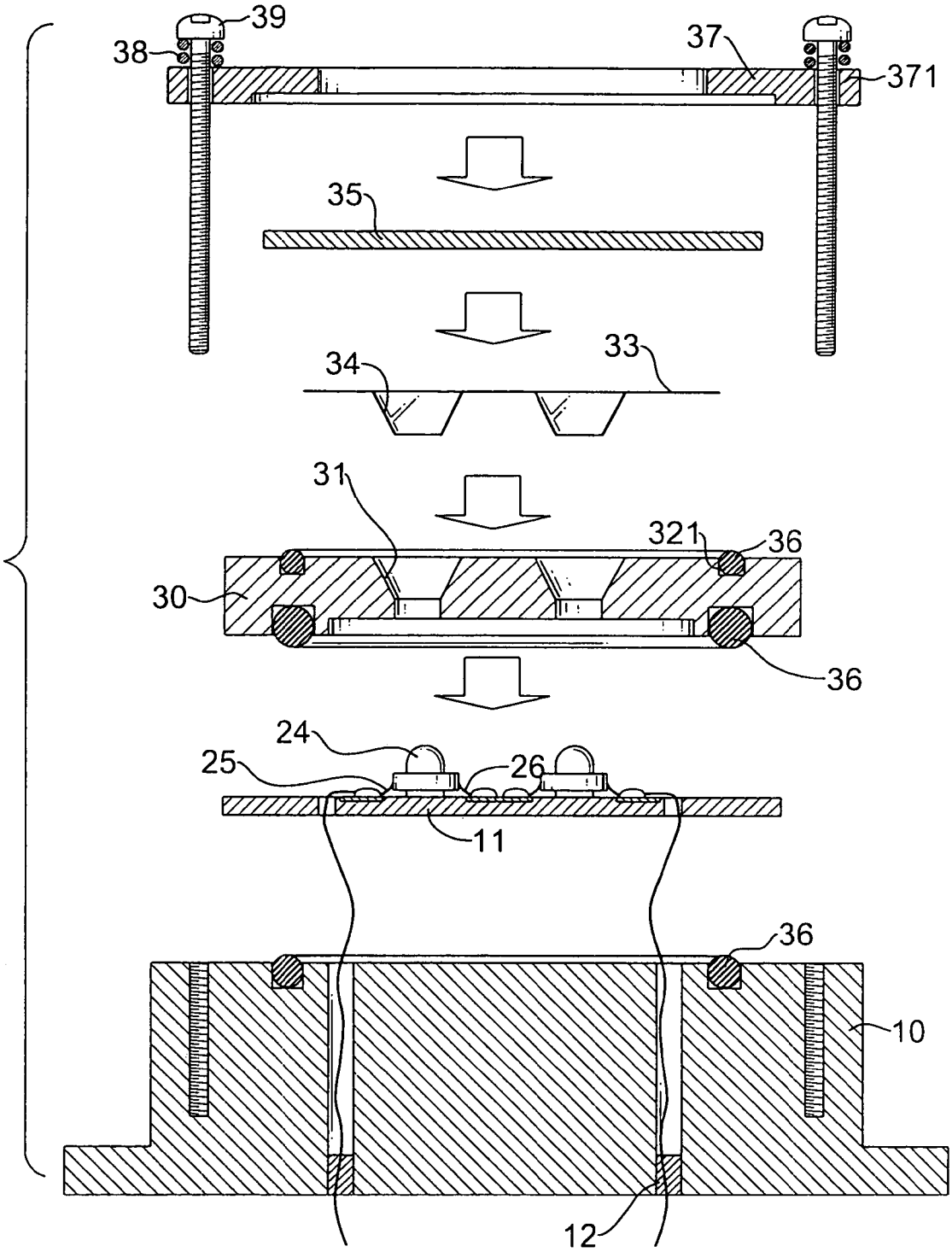
FIG. 4A is an exploded cross sectional view showing the components of the lighting assembly of the present invention.
Figure 4B:
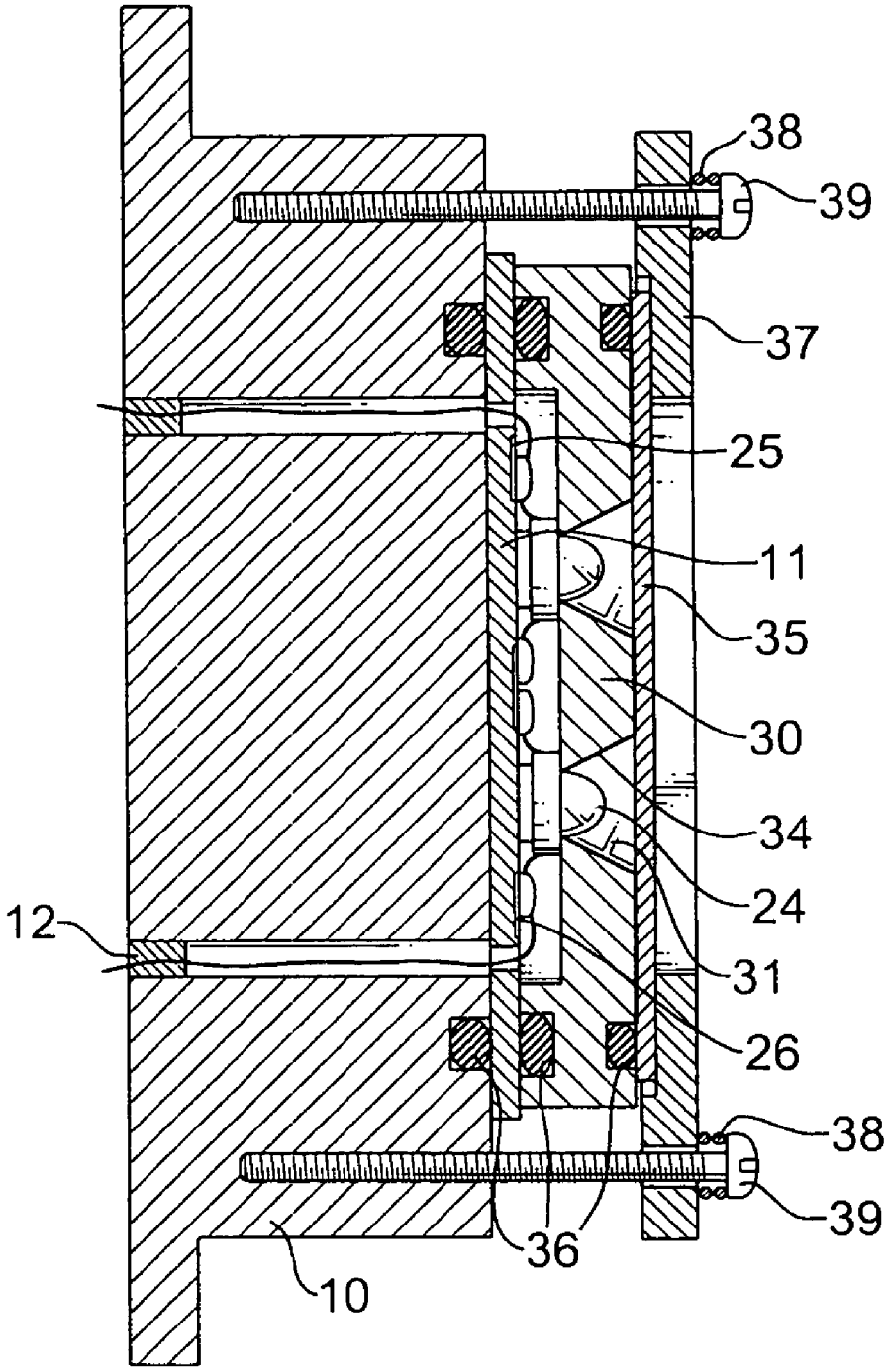
FIG. 4B is a cross sectional view showing the combination of the components in FIG. 4A.

With reference to FIGS. 3, 4A and 4B, after the LEDs (24) are securely welded onto the circuit board (11) and the soldering plate (20) is removed from the combination of the heat conductive plate (10), the circuit board (11) and the LEDs (24), a fixing plate (30), a reflection plate (33), a transparent plate (35), and a cover (37) are provided to the combination. The fixing plate (30) has multiple first conical holes (31) defined through the fixing plate (30) to correspond to the LEDs (24) on top of the circuit board (11), fixing holes (32) defined in opposed sides of the fixing plate (30) and grooves (321) defined in a top face and a bottom face of the fixing plate (30) to receive therein a sealing material (36). The reflecting plate (33) is preferably made of metal and has multiple second conical holes (34) to correspond to the first conical holes (31) so that when the reflecting plate (33) is mounted on top of the fixing plate (30) to have the second conical holes (34) received in the corresponding first conical holes (31), light from the LEDs (24) is able to be concentrated by the first conical holes (31) and the second conical holes (34). The transparent plate (35) is attached to a free side of the reflection plate (33) and the cover (37) is to be securely connected to the heat conductive plate (10).

The cover (37) has positioning holes (371) defined through the cover (37) to correspond to the fixing holes (32) and threaded bolts (39) corresponding to the positioning holes (371). Furthermore, in order to sustain secured engagement of the threaded bolts (39) to the cover (37), the fixing plate (30) and the heat conductive plate (10), washers (38) are provided between each of the threaded bolts (39) and the cover (37). Therefore, after the threaded bolts (39) are inserted into the corresponding washers (38), the positioning holes (371), the fixing holes (32) of the fixing plate (30) and into the heat conductive plate (10), the transparent plate (35), the reflective plate (33), the fixing plate (30) and the circuit board (11) are securely and fixedly sandwiched between the cover (37) and the heat conductive plate (10).

Figure 5:
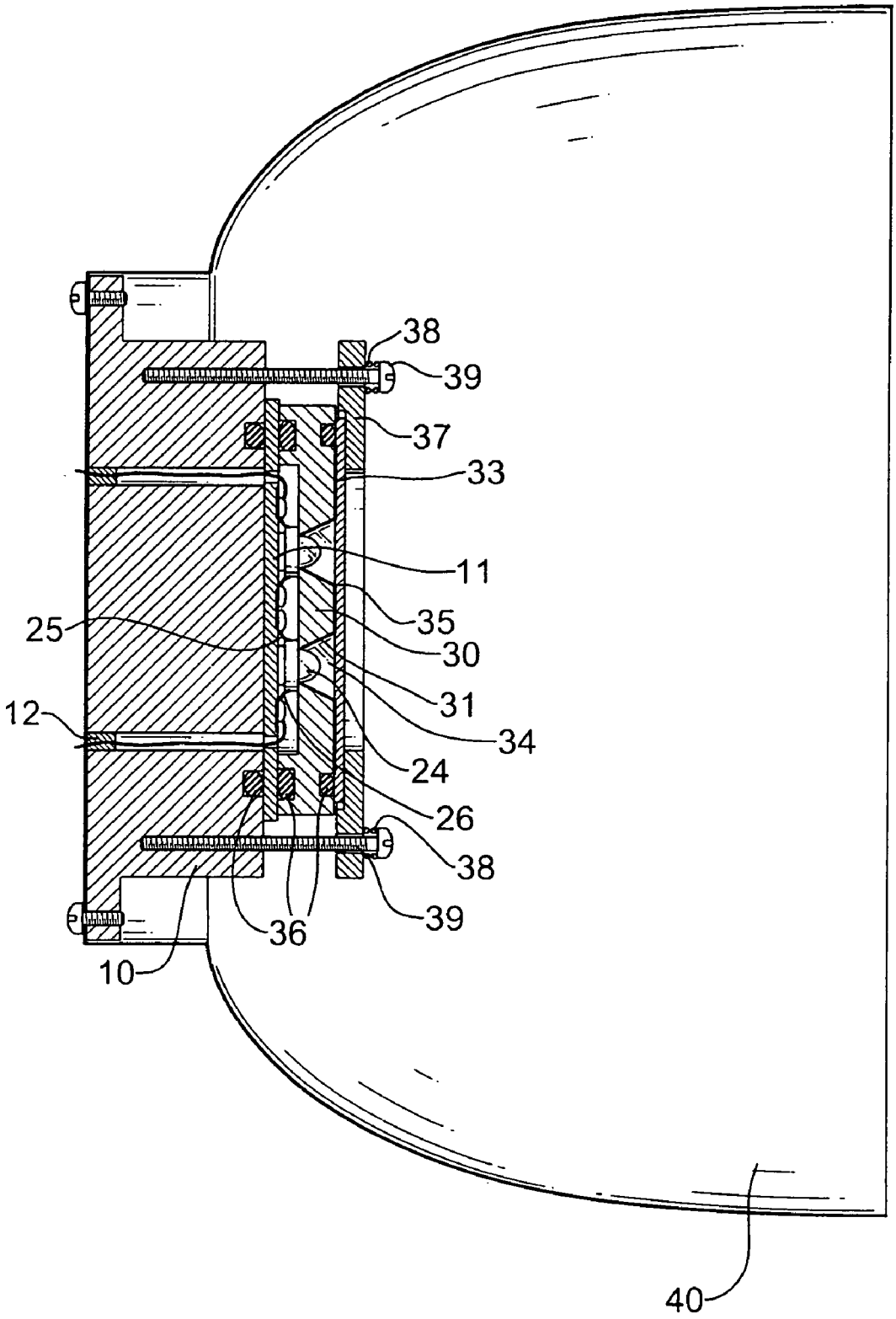
FIG. 5 is a schematic view showing that a cover is mounted to the assembly of the present invention.
Figure 6:
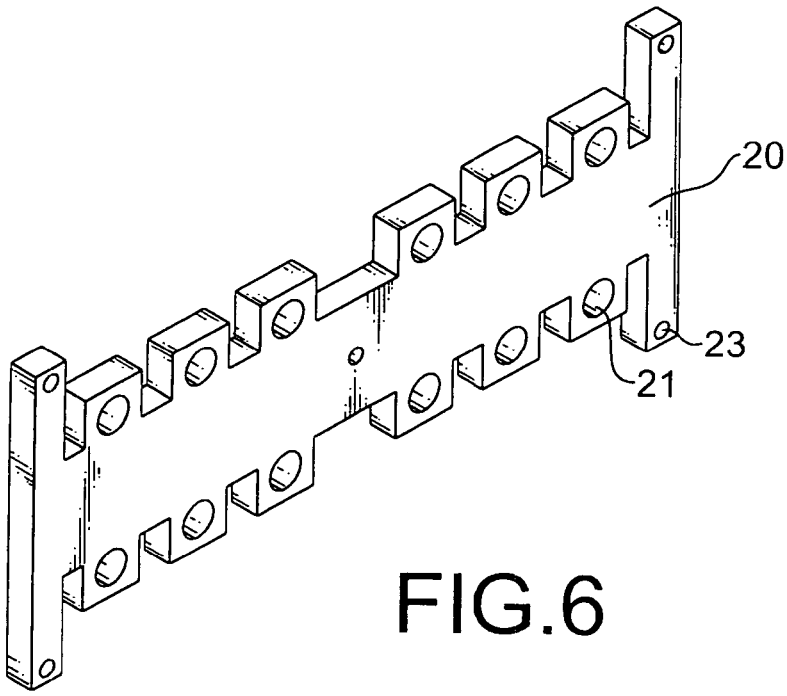
FIG. 6 is a perspective view of a different embodiment of the soldering plate.
Figure 7:
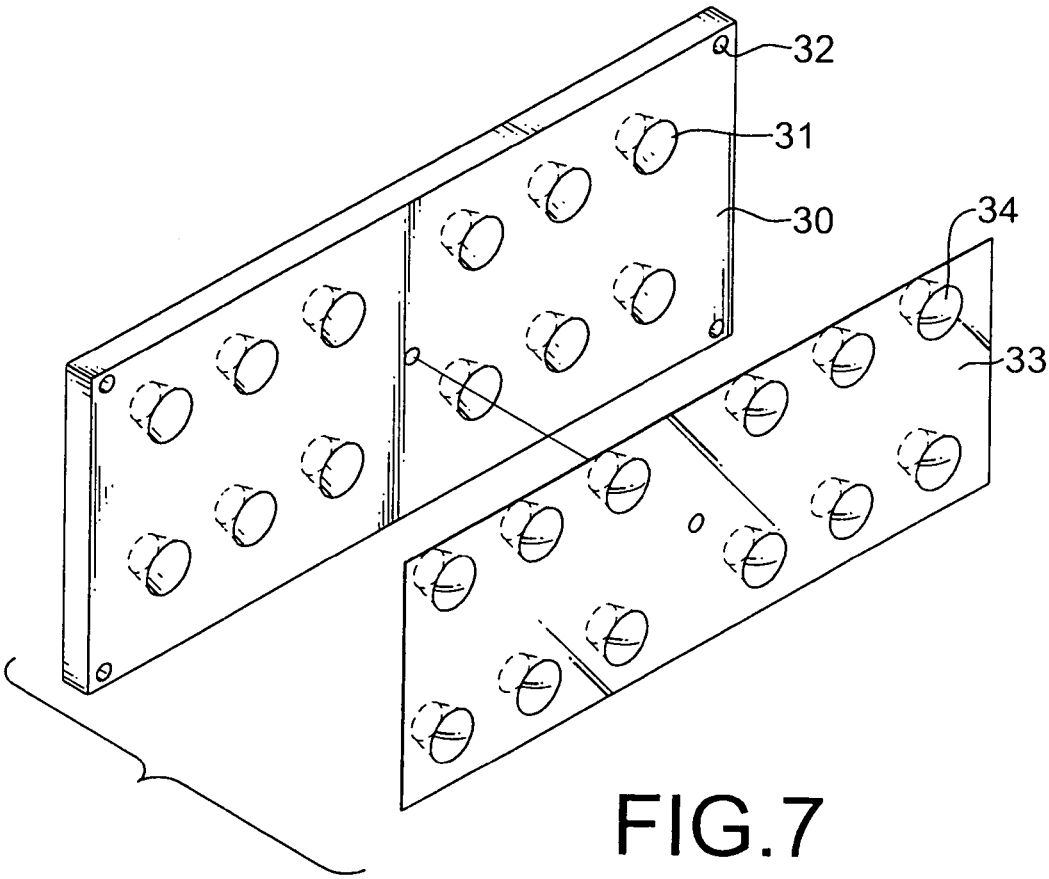
FIG. 7 is a perspective view of a different embodiment of the fixing plate and of the transparent plate.
Figure 8:
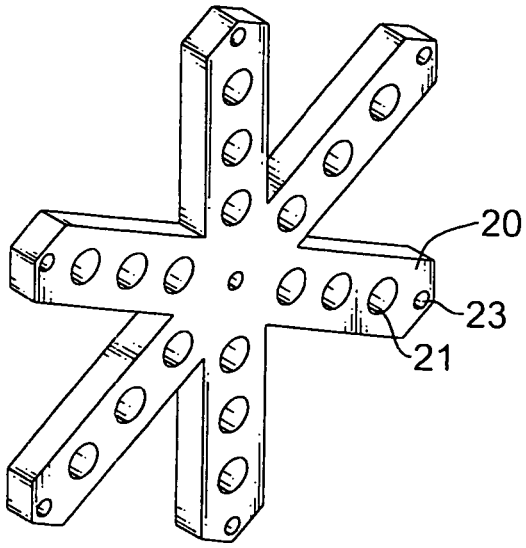
FIG. 8 is a perspective view of still a different embodiment of the soldering plate.
Figure 9:
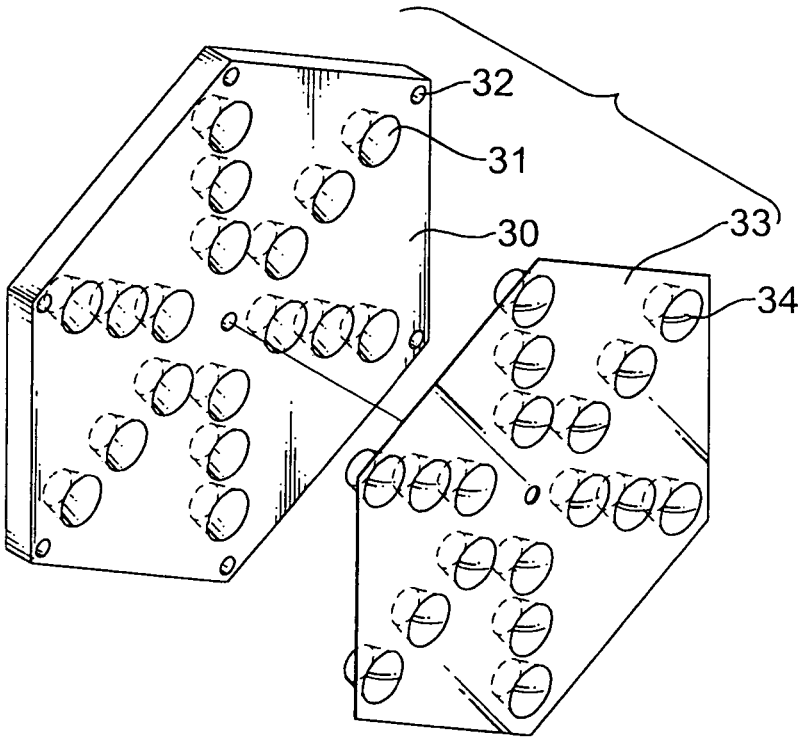
FIG. 9 is a perspective view of still a different embodiment of the fixing plate and of the transparent plate.
Figure 10:
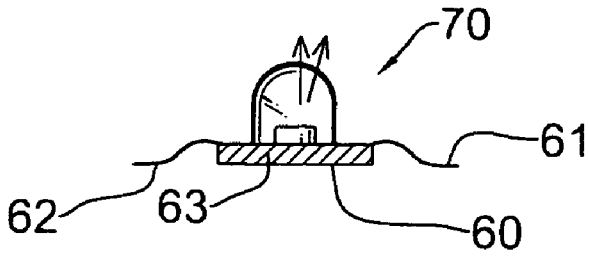
FIG.10 PRIOR ART
FIG. 10 is a schematic side plan view in partial cross section of a conventional lighting assembly.
Figure 11:
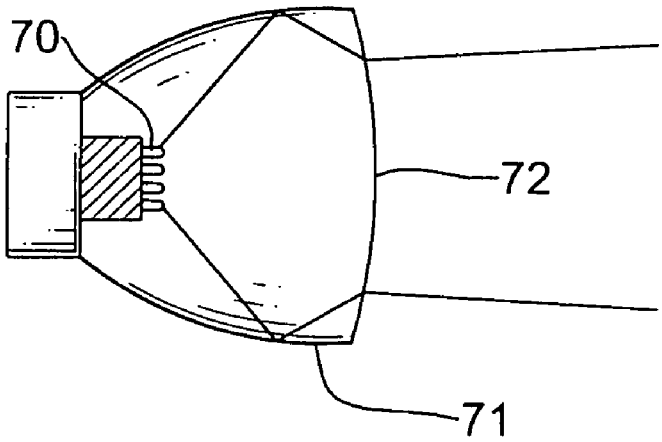
FIG.11 PRIOR ART
FIG. 11 is a schematic side plan view of a conventional lighting assembly with a cover mounted thereto.

In order to improve a waterproof feature of the present invention, the sealing material (36) is further provided between the heat conductive plate (10) and the circuit board (11). Further, with reference to FIG. 5, a light concentration cap (40) is able to be mounted to the heat conductive plate (10) to enhance light concentration effect so as to prevent illuminosity loss during light transmission of the LEDs (24).

With reference to FIGS. 6 to 9, it is noted that the structure of the soldering plate (20), the fixing plate (30) and the reflection plate (33) is the same as aforementioned structure. The only difference shown in these drawings is that the soldering plate (20), the fixing plate (30) and the reflection plate (33) may have different shapes relative to the embodiment in the earlier embodiment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lighting assembly comprising:

a circuit board having multiple light emitting diodes on top of the circuit board;

a heat conductive plate securely connected to a side of the circuit board for dissipating heat from the circuit board;

a soldering plate removably connected to the circuit board and having multiple LED holes defined through the soldering plate to correspond to the LEDs on the circuit board, screw holes defined in corners of the soldering plate to correspond to and receive therein screws extending through the screw holes and into the heat conductive plate and soldering holes so arranged that one LED hole is sandwiched between two adjacent soldering holes such that electrical wires of a corresponding one of the LEDs are able to be welded onto the circuit board via the soldering holes;

a fixing plate securely connected to the circuit board after the soldering plate is removed from engagement with the circuit board, the fixing plate having multiple first conical holes defined through the fixing plate to correspond to one of the LEDs on the circuit board and fixing holes defined through the fixing plate;

a transparent plate securely engaged with the fixing plate; and a cover having multiple positioning holes to correspond to the fixing holes to allow extension of threaded bolts through the positioning holes, the fixing holes, the circuit board and into the heat conductive plate to secure engagement among the heat conductive plate, the circuit board, the fixing plate, the transparent plate and the cover.

2. The lighting assembly as claimed in claim 1 further comprising a reflection plate sandwiched between the fixing plate and the transparent plate and having multiple second conical holes to correspond to the first conical holes such that light from the LEDs is reflected and concentrated.

3. The lighting assembly as claimed in claim 2, wherein a sealing material is provided between the circuit board and the fixing plate and between the fixing plate and the reflection plate to increase waterproof capability.

4. The lighting assembly as claimed in claim 3, wherein the sealing material is further provided between the heat conductive plate and the circuit board.

5. The lighting assembly as claimed in claim 1 further comprising washers provided to the threaded bolts to sustain secured engagement of the threaded bolts to the cover.

6. The lighting assembly as claimed in claim 2 further comprising washers provided to the threaded bolts to sustain secured engagement of the threaded bolts to the cover.

7. The lighting assembly as claimed in claim 3 further comprising washers provided to the threaded bolts to sustain secured engagement of the threaded bolts to the cover.

8. The lighting assembly as claimed in claim 4 further comprising washers provided to the threaded bolts to sustain secured engagement of the threaded bolts to the cover.

* * * * *